US007634400B2

(12) United States Patent
Averty et al.

(10) Patent No.: US 7,634,400 B2
(45) Date of Patent: Dec. 15, 2009

(54) DEVICE AND PROCESS FOR USE IN ENCODING AUDIO DATA

(75) Inventors: Charles Averty, Singapore (SG); Xue Yao, Singapore (SG); Ranjot Singh, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 844 days.

(21) Appl. No.: 10/795,962

(22) Filed: Mar. 8, 2004

(65) Prior Publication Data

US 2004/0243397 A1 Dec. 2, 2004

(30) Foreign Application Priority Data

Mar. 7, 2003 (SG) ..... 200301300-0

(51) Int. Cl.
*G10L 19/14* (2006.01)
*G10L 19/00* (2006.01)

(52) U.S. Cl. ..... 704/205; 704/200.1; 704/500

(58) Field of Classification Search ..... None
See application file for complete search history.

(56) References Cited

U.S. PATENT DOCUMENTS 6,385,572 B2 * 5/2002 Hu ..... 704/200.1
6,950,794 B1 * 9/2005 Subramaniam et al. .. 704/200.1
7,003,449 B1 * 2/2006 Absar et al. ..... 704/200.1

OTHER PUBLICATIONS

Chan et al., "A low-complexity, high-quality, 64-Kbps audio codec with efficient bit allocation", Digital Signal Processing, vol. 13, Issue 1, Jan. 2003, pp. 23-41.*
Davidson, Grant A. et al., "Parametric Bit Allocation in a Perceptual Audio Coder," 97th Convention of Audio Engineering Society. 1-20, Nov. 1994.
Pan, Davis, "A Tutorial on MPEG/Audio Compression," IEEE Journal on Multimedia. Summer, 1995.
Zwicker, E, "Subdivision of the Audible Frequency Range into Critical Bands," Journal of the Acoustical Society of America. 33(2):248, Feb. 1961.

* cited by examiner

*Primary Examiner*—David R Hudspeth
*Assistant Examiner*—Brian L Albertalli
(74) *Attorney, Agent, or Firm*—David V. Carlson; Lisa K. Jorgenson

(57) ABSTRACT

A mask generation process for use in encoding audio data, including generating linear masking components from the audio data, generating logarithmic masking components from the linear masking components, and generating a global masking threshold from the logarithmic masking components. The process is a psychoacoustic masking process for use in an MPEG-1-L2 encoder, and includes generating energy values from a Fourier transform of the audio data, determining sound pressure level values from the energy values, selecting tonal and non-tonal masking components on the basis of the energy values, generating power values from the energy values, generating masking thresholds on the basis of the masking components and the power values, and generating signal to mask ratios for a quantizier on the basis of the sound pressure level values and the masking thresholds.

30 Claims, 3 Drawing Sheets

DEVICE AND PROCESS FOR USE IN ENCODING AUDIO DATA

BACKGROUND OF THE INVENTION

1. Field of the Invention

The present invention relates to a device and process for use in encoding audio data, and in particular to a psychoacoustic mask generation process for MPEG audio encoding.

2. Description of the Related Art

The MPEG-1 audio standard, as described in the International Standards Organisation (ISO) document ISO/IEC 11172-3: Information technology—Coding of moving pictures and associated audio for digital storage media at up to about 1.5 Mbps ("the MPEG-1 standard"), defines processes for lossy compression of digital audio and video data. The MPEG-1 standard defines three alternative processes or "layers" for audio compression, providing progressively higher degrees of compression at the expense of increasing complexity. The second layer, referred to as MPEG-1-L2, provides an audio compression format widely used in consumer multimedia applications. As these applications progress from providing playback only to also providing recording, a need arises for consumer-grade and consumer-priced devices that can generate MPEG-1-L2 compliant audio data.

The reference implementation for an MPEG-1-L2 encoder described in the MPEG-1 standard is not suitable for real-time consumer applications, and requires considerable resources in terms of both memory and processing power. In particular, the psychoacoustic masking process used in the MPEG-1-L2 audio encoder referred to uses a number of successive and processing intensive power and energy data conversions that also incur a repeated loss in precision.

Accordingly, it is desired to address the above or at least provide a useful alternative.

BRIEF SUMMARY OF THE INVENTION

In accordance with one embodiment of the present invention there is provided a mask generation process for use in encoding audio data, including:

generating linear masking components from said audio data;

generating logarithmic masking components from said linear masking components; and generating a global masking threshold from the logarithmic masking components.

One embodiment of the present invention also provides a mask generation process for use in encoding audio data, including:

generating respective masking thresholds from logarithmic masking components using a masking function of the form:

$$vf=-17*dz,\ 0\leqq dz<8$$

One embodiment of the present invention also provides a mask generation process for use in encoding audio data, including:

generating a global masking threshold from logarithmic masking components according to:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

where i and j are indices of spectral audio data, z(i) is a Bark scale value for spectral line i, $LT_{tonal}[z(j), z(i)]$ is a tonal masking threshold for lines i and j, $LT_{tonal}[z(j),z(i)]$ is a non-tonal masking threshold for lines i and j, m is the number of tonal spectral lines, and n is the number of non-tonal spectral lines.

Another embodiment of the present invention also provides a mask generator for an audio encoder, said mask generator adapted to generate linear masking components from input audio data, logarithmic masking components from said linear masking components; and a global masking threshold from the logarithmic masking components.

Another embodiment of the present invention also provides a psychoacoustic masking process for use in an audio encoder, including:

generating energy values from Fourier transformed audio data;

determining sound pressure level values from said energy values;

selecting tonal and non-tonal masking components on the basis of said energy values;

generating power values from said energy values;

generating masking thresholds on the basis of said masking components and said power values; and generating signal to mask ratios for a quantizer on the basis of said sound pressure level values and said masking thresholds.

BRIEF DESCRIPTION OF THE DRAWINGS

Preferred embodiments of the present invention are hereinafter described, by way of example only, with reference to the accompanying drawings, wherein.

DETAILED DESCRIPTION OF THE INVENTION

Figure 1:
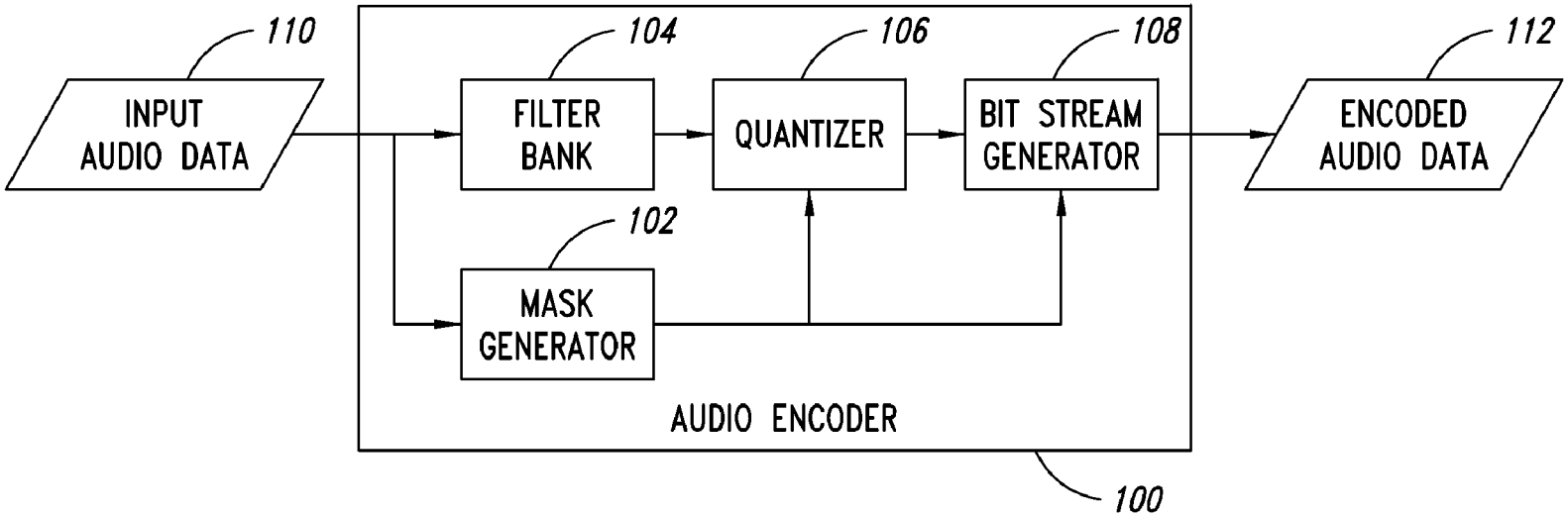
FIG. 1 is a block diagram of a preferred embodiment of an audio encoder.

As shown in FIG. 1, an audio encoder 100 includes a mask generator 102, a filter bank 104, a quantizer 106, and a bit stream generator 108. The audio encoder 100 executes an audio encoding process that generates encoded audio data 112 from input audio data 110. The encoded audio data 112 constitutes a compressed representation of the input audio data 110.

The audio encoding process executed by the encoder 100 performs encoding steps based on MPEG-1-L2 processes described in the MPEG-1 standard. The time-domain input audio data 110 is convened into sub-bands by the filter bank 104, and the resulting frequency-domain data is then quantized by the quantizer 106. The bitstream generator 108 then generates encoded audio data or bitstream 112 from the quantized data. The quantizer 106 performs bit allocation and quantization based upon masking data generated by the mask generator 102. The masking data is generated from the input audio data 110 on the basis of a psychoacoustic model of human hearing and aural perception. The psychoacoustic modeling takes into account the frequency-dependent thresholds of human hearing, and a psychoacoustic phenomenon referred to as masking, whereby a strong frequency component close to one or more weaker frequency components tends to mask, the weaker components, rendering them inaudible to a human listener. This makes it possible to omit the weaker frequency components when encoding audio data, and thereby achieve a higher degree of compression, without adversely affecting the perceived quality of the encoded audio data 112. The masking data comprises a signal-to-mask ratio value for each frequency sub-band. These signal-to-mask ratio values represent the amount of signal masked by the human ear in each frequency sub-band. The quantizer 106 uses this information to decide how best to use the available number of data bits to represent the input audio signal 110.

In known or prior art MPEG-1-L2 encoders, the generation of masking data has been found to be the most computationally intensive component of the encoding process, representing up to 50% of the total processing resources. The MPEG-1 standard provides two example implementations of the psychoacoustic model: psychoacoustic model 1 (PAM1) is less complex and makes more compromises on quality than psychoacoustic model 2 (PAM2). PAM2 has better performance for lower bit rates. Nonetheless, quality tests indicate that PAM1 can achieve good quality encoding at high bit rates such as 256 and 384 kbps. However, PAM1 is implemented in floating point arithmetic and is not optimized for chip-based encoders. As described in G. A. Davidson et. al., *Parametric Bit Allocation in a Perceptual Audio Coder,* 97th Convention of Audio Engineering Society, November 1994, it has been estimated that PAM1 demands more than 30 MIPS of computing power per channel.

Moreover, despite using the C double precision type throughout, the ISO implementation uses an extremely large number of arithmetic operations, each resulting in a loss of precision at each step of the psychoacoustic masking data generation process.

The psychoacoustic mask generation process 300 executed by the mask generator 102 provides an implementation of the psychoacoustic model that maintains quality whilst significantly reducing the computational requirements.

In order to most clearly describe the advantages of the psychoacoustic mask generation process 300, the steps of the process are described below with reference to a prior art process 200 for generating psychoacoustic masking data, as described in the MPEG-1 standard.

In the described embodiment, the audio encoder is a standard digital signal processor (DSP) such as a TMS320 series DSP manufactured by Texas Instruments. The audio encoding modules 102 to 108 of the encoder 100 are software modules stored in the firmware of the DSP-core. However, it will be apparent that at least part of the audio encoding modules 102 to 108 could alternatively be implemented as dedicated hardware components such as application-specific integrated circuits (ASICs).

Figure 2:
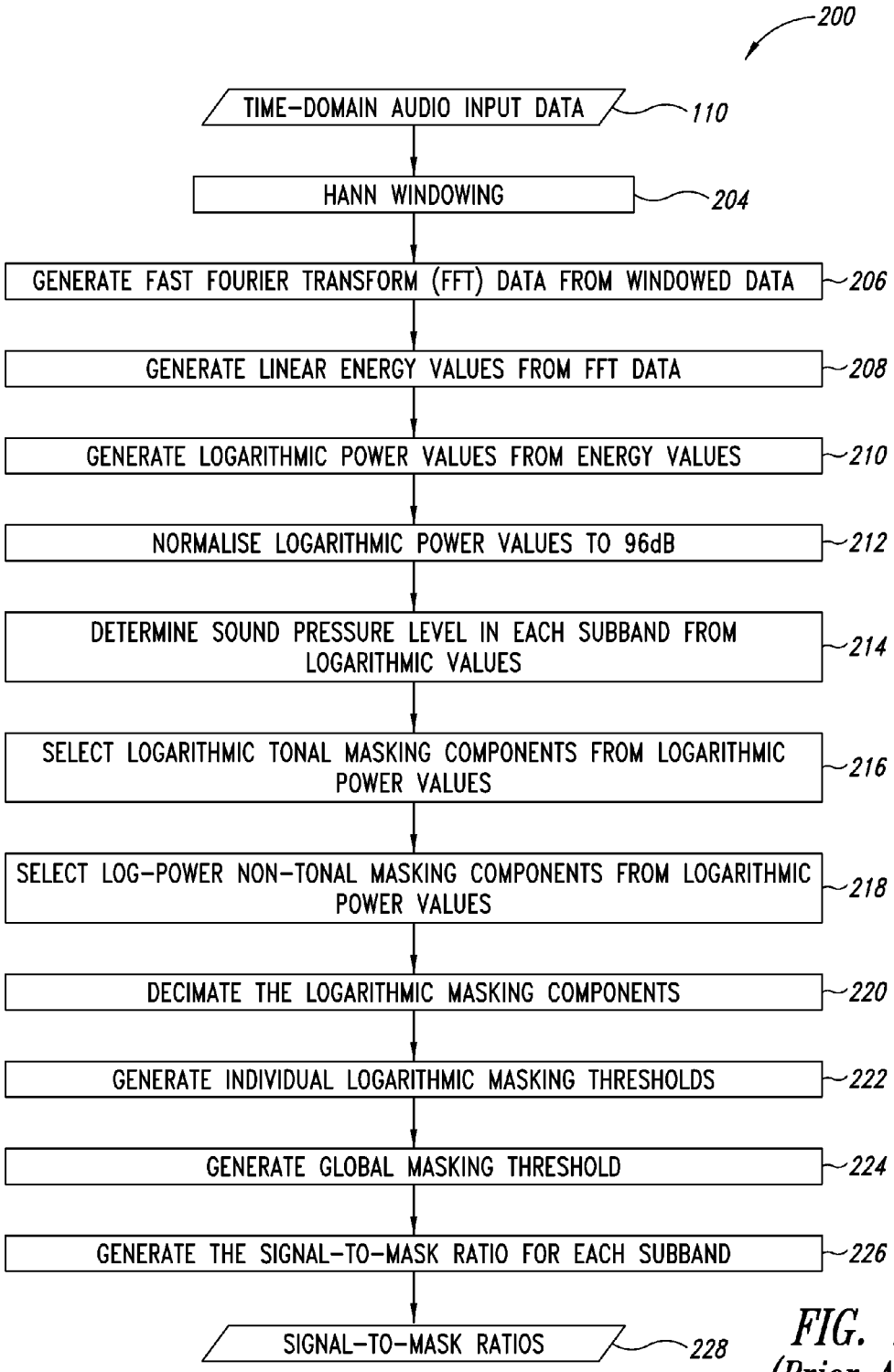
FIG. 2 (Prior Art)
FIG. 2 is a flow diagram of a prior art process for generating masking data.
Figure 3:
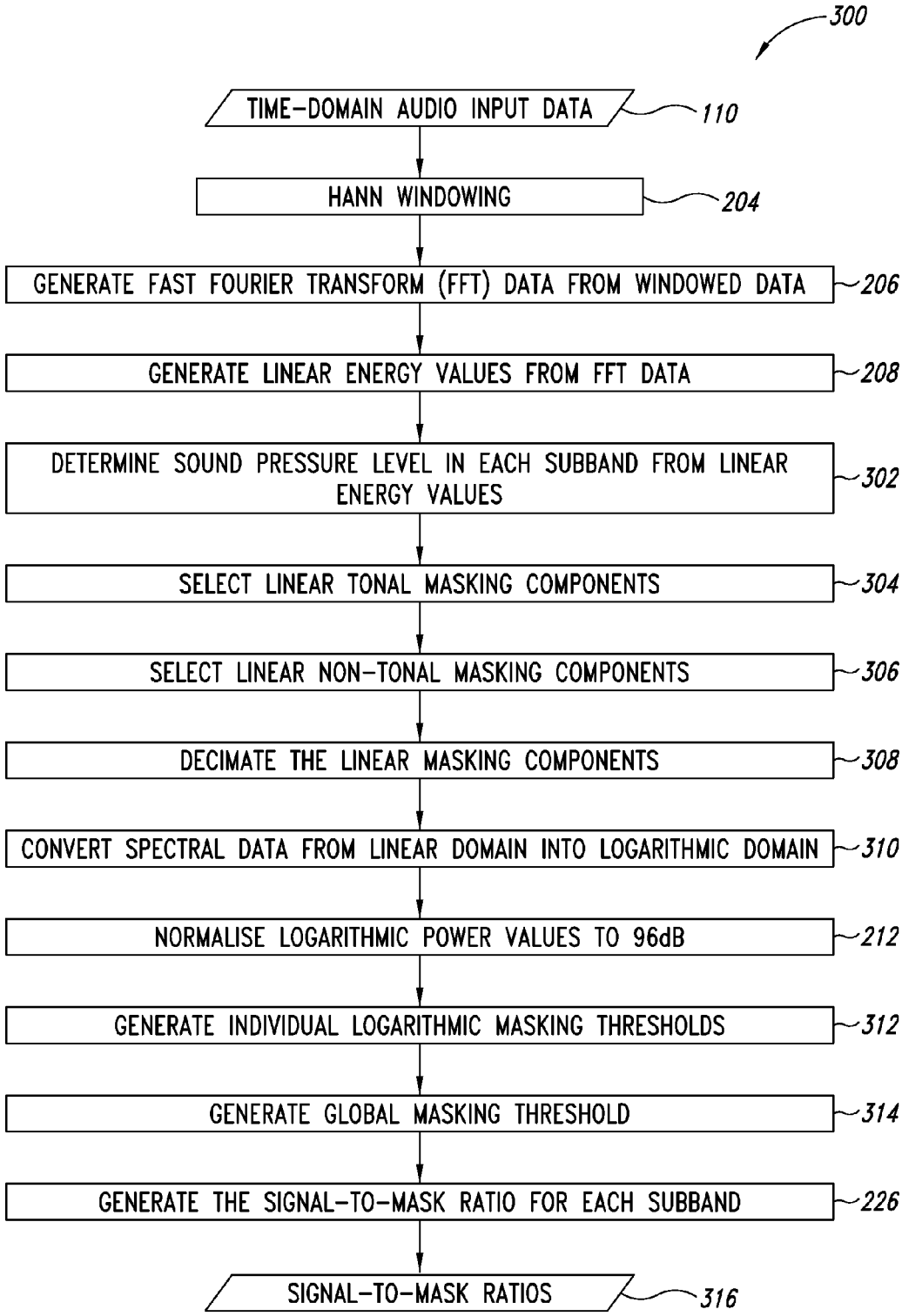
FIG. 3 is a flow diagram of a mask generation process executed by a mask generator of the audio encoder.

As shown in FIGS. 2 and 3, both the psychoacoustic mask generation process 300 and the prior art process 200 for generating masking data begin by Hann windowing the 512-sample time-domain input audio data frame 110 at step 204. The Hann windowing effectively centers the 512 samples between the previous samples and the subsequent samples, using a Hann window to provide a smooth taper. This reduces ringing edge artifacts that would otherwise be produced at step 206 when the time-domain audio data 110 is converted to the frequency domain using a 1024-point fast Fourier transform (FFT). At step 208, an array of 512 energy values for respective frequency sub-bands is then generated from the symmetric array of 1024 FFT output values, according to:

$$E(n)=|X(n)|^2=X_R^2(n)+X_I^2(n)$$

where $X(n)=X_R(n)+iX_I(n)$ is the FFT output of the nth spectral line.

In this specification, a value or entity is described as logarithmic or as being in the logarithmic-domain if it has been generated as the result of evaluating a logarithmic function. When a logarithmic value or entity is exponentiated by the reverse operation, it is described as linear or as being in the linear-domain.

In the prior art process 200, the linear energy values E(n) are then converted into logarithmic power spectral density (PSD) values P(n) at step 210, according to $P(n)=10\log_{10}E(n)$, and the linear energy values E(n) are not used again. The PST) values are normalized to 96 dB at step 212.

Steps 210 and 212 are omitted from the mask generation process 300.

The next step in both processes is to generate sound pressure level (SPL) values for each sub-band. In the prior art process, an SPL value $L_{sb}(n)$ is generated for each sub-band n at step 214, according to:

$$L_{sb}(n) = \mathrm{MAX}[X_{spl}(n),\ 20*\log(scf_{\max}(n)*32768)-10]\ \mathrm{dB}$$

and $$X_{spl}(n) = 10*\log_{10}\left(\sum_k 10^{X(k)/10}\right)\ \mathrm{dB}$$

where $scf_{max}(n)$ is the maximum of the three scale factors of sub-band n within an MPEG 1 L2 audio frame comprising 1152 stereo samples, X(k) is the PSD value of index k, and the summation over k is limited to values of k within sub-band n. The "−10 dB" term corrects for the difference between peak and RMS levels.

Significantly, the prior art generation of SPL values involves evaluating many exponentials and logarithms in order to convert logarithmic power values to linear energy values, sum them, and then convert the summed linear energy values back to logarithmic power values. Each conversion between the logarithmic and linear domains is computationally expensive and degrades the precision of the result.

In the mask generation process 300, $L_{sb}(n)$ is generated at step 302 using the same first formula for $L_{sb}(n)$, but with:

$$X_{spl}(n) = 10*\log_{10}\left(\sum_k X(k)\right)+96\ \mathrm{dB}$$

where X(k) is the linear energy value of index k. The "96 dB" term is used to normalize $L_{sb}(n)$. It will be apparent that this improves upon the prior art by avoiding exponentiation. Moreover, the efficiency of generating the SPL values is significantly improved by approximating the logarithm by a second order Taylor expansion.

Specifically, representing the argument of the logarithm as Ipt, this is first normalized by determining x such that:

$$Ipt=(1-x)2^m,\ 0.5<1-x\leqq 1$$

Using a second order Taylor expansion, $$\ln(1-x)\approx -x-x^2/2$$

the logarithm can be approximated as:

$$\log_{10}(Ipt)\approx[m*\ln(2)-(x+x^2/2)]*\log_{10}(e)=[m*\ln(2)-(x+x*x*0.5)]*\log_{10}(e)$$

Thus the logarithm is approximated by four multiplications and two additions, providing a significant improvement in computational efficiency.

The next step is to identify frequency components for masking. Because the tonality of a masking component affects the masking threshold, tonal and non-tonal (noise) masking components are determined separately.

First, local maxima are identified. A spectral line X(k) is deemed to be a local maximum if $$X(k)>X(k-1) \text{ and } X(k)\geqq X(k+1)$$

In the prior art process 200, a local maximum X(k) thus identified is selected as a logarithmic tonal masking component at step 216 if:

$$X(k)-X(k+j)\geqq 7 \text{ dB}$$

where j is a searching range that varies with k. If X(k) is found to be a tonal component, then its value is replaced by:

$$X_{tonal}(k)=10\log_{10}(10^{X(k-1)/10}+10^{X(k)/10}+10^{X(k+1)/10})$$

All spectral lines within the examined frequency range are then set to $-\infty$ dB.

In the mask generation process 300, a local maximum X(k) is selected as a linear tonal masking component at step 304 if:

$$X(k)*10^{-0.7}\geqq X(k+j)$$

If X(k) is found to be a tonal component, then its value is replaced by:

$$X_{tonal}(k)=X(k-1)+X(k)+X(k+1)$$

All spectral lines within the examined frequency range are then set to 0.

The next step in either process is to identify and determine the intensity of non-tonal masking components within the bandwidth of critical sub-bands. For a given frequency, the smallest band of frequencies around that frequency which activate the same part of the basilar membrane of the human ear is referred to as a critical band. The critical bandwidth represents the ear's resolving power for simultaneous tones. The bandwidth of a sub-band varies with the center frequency of the specific critical band. As described in the MPEG-1 standard, 26 critical bands are used for a 48 kHz sampling rate. The non-tonal (noise) components are identified from the spectral lines remaining after the tonal components are removed as described above.

At step 218 of the prior art process 200, the logarithmic powers of the remaining spectral lines within each critical band are converted to linear energy values, summed and then converted back into a logarithmic power value to provide the SPL of the new non-tonal component $X_{noise}(k)$ corresponding to that critical band. The number k is the index number of the spectral line nearest to the geometric mean of the critical band.

In the mask generation process 300, the energy of the remaining spectral lines within each critical band are summed at step 306 to provide the new non-tonal component $X_{noise}(k)$ corresponding to that critical band:

$$X_{noise}(k)=\sum_{k} X(k)$$

for k in sub-band n. Only addition is used, and no exponential or logarithmic evaluations are required, providing a significant improvement in efficiency.

The next step is to decimate the tonal and non-tonal masking components. Decimation is a procedure that is used to reduce the number of masking components that are used to generate the global masking threshold.

In the prior art process 200, logarithmic tonal components $X_{tonal}(k)$ and non-tonal components $X_{noise}(k)$ are selected at step 220 for subsequent use in generating the masking threshold only if:

$$X_{tonal}(k)\geqq LT_q(k) \text{ or } X_{noise}(k)\geqq LT_q(k)$$

respectively, where $LT_q(k)$ is the absolute threshold (or threshold in quiet) at the frequency of index k, threshold in quiet values in the logarithmic domain are provided in the MPEG-1 standard.

Decimation is performed on two or more tonal components that are within a distance of less than 0.5 Bark, where the Bark scale is a frequency scale on which the frequency resolution of the ear is approximately constant, as described in E. Zwicker, *Subdivision of the Audible Frequency Range into Critical Bands*, J. Acoustical Society of America, vol. 33, p. 248, February 1961. The tonal component with the highest power is kept while the smaller component(s) are removed from the list of selected tonal components. For this operation, a sliding window in the critical band domain is used with a width of 0.5 Bark.

In the mask generation process 300, linear components are selected at step 308 only if:

$$X_{tonal}(k)\geqq LT_qE(k) \text{ or } X_{noise}(k)\geqq LT_qE(k)$$

where $LT_qE(k)$ are taken from a linear-domain absolute threshold table pre-generated from the logarithmic domain absolute threshold table $LT_q(k)$ according to:

$$LT_qE(k)=10^{\log_{10}[LT_q(k)-96]/10}$$

where the "−96" term represents denormalization.

After denormalization, the spectral data in the linear energy domain are converted into the logarithmic power domain at step 310. In contrast to step 206 of the prior art process, the evaluation of logarithms is performed using the efficient second-order approximation method described above. This conversion is followed by normalization to the reference level of 96 dB at step 212.

Having selected and decimated masking components, the next step is to generate individual masking thresholds. Of the original 512 spectral data values, indexed by k, only a subset, indexed by i, is subsequently used to generate the global masking threshold, and this step determines that subset by subsampling, as described in the MPEG-1 standard.

The number of lines n in the subsampled frequency domain depends on the sampling rate. For a sampling rate of 48 kHz, n=126. Every tonal and non-tonal component is assigned an index i that most closely corresponds to the frequency of the corresponding spectral line in the original (i.e., before subsampling) spectral data.

The individual masking thresholds of both tonal and non-tonal components, $LT_{tonal}$ and $LT_{noise}$, are then given by the following expressions:

$$LT_{tonal}[z(j),z(i)]=X_{tonal}[z(j)]+av_{tonal}[z(j)]+vf[z(j),z(i)]\text{dB}$$

$$LT_{noise}[z(j),z(i)]=X_{noise}[z(j)]+av_{noise}[z(j)]+vf[z(j),z(i)]\text{dB}$$

where i is the index corresponding to a spectral line, at which the masking threshold is generated and j is that of a masking component; z(i) is the Bark scale value of the $i^{th}$ spectral line while z(j) is that of the $j^{th}$ line; and terms of the form X[z(j)]

are the SPLs of the (tonal or non-tonal) masking component. The term av, referred to as the masking index, is given by:

$$av_{tonal}=-1.525-0.275*z(j)-4.5 \text{ dB}$$

$$av_{noise}=-1.525-0.175*z(j)-0.5 \text{ dB}$$

vf is a masking function of the masking component and is characterized by different lower and upper slopes, depending on the distance in Bark scale dz, dz=z(i)−z(j)

In the prior art process 200, individual masking thresholds are generated at step 222 using a masking function vf given by:

$$vf=17*(dz+1)-0.4*X[z(j)]-6 \text{ dB, for } -3\leqq dz<-1 \text{ Bark}$$

$$vf=\{0.4*X[z(j)]+6\}*dz \text{ dB, for } -1\leqq dz<0 \text{ Bark}$$

$$vf=17*dz \text{ dB, for } 0\leqq dz<1 \text{ Bark}$$

$$vf=17*dz+0.15*X[z(j)]*(dz-1)\text{dB, for } 1\leqq dz<8 \text{ Bark}$$

where X[z(j)] is the SPL of the masking component with index j. No masking threshold is generated if dz<−3 Bark, or dz>8 Bark.

The evaluation of the masking function vf is the most computationally intensive part of this step of the prior art process. The masking function can be categorized into two types: downward masking (when dz<0) and upward masking (when dz≧0). As described in Davis Pan, *A Tutorial on MPEG/Audio Compression*, IEEE Journal on Multimedia, 1995, downward masking is considerably less significant than upward masking. Consequently, only upward masking is used in the mask generation process 300. Moreover, further analysis shows that the second term in the masking function for 1≦dz<8 Bark is typically approximately one tenth of the first term, −17*dz. Consequently, the second term can be safely discarded.

Accordingly, the mask generation process 300 generates individual masking thresholds at step 312 using a single expression for the masking function vf, as follows:

$$vf=17*dz,\ 0\leqq dz<8$$

This greatly reduces the computational load while maintaining good quality encoding. The masking index av is not modified from that used in the prior art process, because it makes a significant contribution to the individual masking threshold LT and is not computationally demanding.

After the individual masking thresholds have been generated, a global masking threshold is generated.

In the prior art process 200, the global masking threshold $LT_g(i)$ at the $i^{th}$ frequency sample is generated at step 224 by summing the powers corresponding to the individual masking thresholds and the threshold in quiet, according to:

$$LT_g(i)=10\log_{10}\left[10^{LT_q(i)/10}+\sum_{j=1}^{m}10^{LT_{tonal}[z(j),z(i)]}/10+\sum_{j=1}^{n}10^{LT_{noise}[z(j),z(i)]}/10\right]$$

where m is the total number of tonal masking components, and n is the total number of non-tonal masking components. The threshold in quiet $LT_q$ is offset by −12 dB for bit rates ≧96 kbps per channel.

It will be apparent that this step is computationally demanding due to the number of exponentials and logarithms that are evaluated.

In the mask generation process 300, these evaluations are avoided and smaller terms are not used. The global masking threshold $LT_g(i)$ at the $i^{th}$ frequency sample is generated at step 314 by comparing the powers corresponding to the individual masking thresholds and the threshold in quiet, as follows:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

The largest tonal masking components and of non-tonal masking components are identified. They are then compared with $LT_q(i)$. The maximum of these three values is selected as the global masking threshold at the $i^{th}$ frequency sample. This reduces computational demands at the expense of occasional over allocation. As above, the threshold in quiet $LT_q$ is offset by −12 dB for bit rates ≧96 kbps per channel.

Finally, signal-to-mask ratio values are generated at step 226 of both processes. First, the minimum masking level $LT_{min}(n)$ in sub-band n is determined by the following expression:

$$LT_{min}(n)=\text{Min}[LT_g(i)]\text{dB; for f(i) in subband n,}$$

where f(i) is the $i^{th}$ frequency line within sub-band n. A minimum masking threshold $LT_{min}(n)$ is determined for every sub-band. The signal-to-mask ratio for every sub-band n is then generated by subtracting the minimum masking threshold of that sub-band from the corresponding SPL value:

$$SMR_{sb}(n)=L_{sb}(n)-LT_{min}(n)$$

The mask generator 102 sends the signal-to-mask ratio data $SMR_{sb}(n)$ for each sub-band n to the quantizer 104, which uses it to determine how to most effectively allocate the available data bits and quantize the spectral data, as described in the MPEG-1 standard.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without departing from the spirit and scope of the invention. Accordingly, the invention is not limited except as by the appended claims.

The invention claimed is:

1. A mask generation process for use in encoding audio data, including:

generating linear masking components from said audio data;

generating logarithmic masking components from said linear masking components; and generating a global masking threshold from the logarithmic masking components, including generating masking thresholds from said logarithmic masking components using a masking function of the form:

$$vf=-17*dz\ 0\leqq dz<8.$$

2. The mask generation process as claimed in claim 1, wherein said step of generating linear masking components includes:

generating linear components in a frequency domain from said audio data;

selecting a first subset of said linear components as linear tonal components; and selecting a second subset of said linear components as linear non-tonal components.

3. The mask generation process as claimed in claim 2, including generating sound pressure levels from said linear components using a second-order Taylor expansion of a logarithmic function.

4. The mask generation process as claimed in claim 3, including generating a normalized value corresponding to an argument of said logarithmic function, and using said normalized value in said Taylor expansion.

5. The mask generation process as claimed in claim 2 wherein said step of generating a global masking threshold includes:

decimating said linear tonal components and said linear non-tonal components; and generating masking thresholds from the decimated linear tonal components and the decimated linear non-tonal components.

6. The mask generation process as claimed in claim 5, wherein said step of generating a global masking threshold includes determining maximum components of said masking thresholds and predetermined threshold values.

7. The mask generation process as claimed in claim 1 wherein said logarithmic masking components are generated using a second-order Taylor expansion of a logarithmic function.

8. The mask generation process as claimed in claim 1 wherein said linear masking components include linear energy components, and said logarithmic masking components include logarithmic power components.

9. The mask generation process as claimed in claim 1 wherein said process is an MPEG-1layer 2 audio encoding process.

10. A mask generation process for use in encoding audio data, including:

generating linear masking components from said audio data wherein generating linear masking components includes:

generating linear components in a frequency domain from said audio data;

selecting a first subset of said linear components as linear tonal components; and selecting a second subset of said linear components as linear non-tonal components;

generating sound pressure levels from said linear components using a second-order Taylor expansion of a logarithmic function;

generating a normalized value corresponding to an argument of said logarithmic function, and using said normalized value in said Taylor expansion;

generating logarithmic masking components from said linear masking components; and generating a global masking threshold from the logarithmic masking components, including:

generating said normalized value x for said argument Ipt, according to:

$$Ipt=(1-x)2^m, 0.5<1-x\leqq 1$$

and using a second order Taylor expansion of the form $$\ln(1-x)\approx x-x^2/2$$

to approximate said logarithmic function as:

$$\log_{10}(Ipt)\approx[m*\ln(2)-(x+x^2/2)]*\log_{10}(e).$$

11. A mask generation process for use in encoding audio data, including:

generating linear masking components from said audio data wherein generating linear masking components includes:

generating linear components in a frequency domain from said audio data;

selecting a first subset of said linear components as linear tonal components; and selecting a second subset of said linear components as linear non-tonal components;

generating logarithmic masking components from said linear masking components; and generating a global masking threshold from the logarithmic masking components, including:

decimating said linear tonal components and said linear non-tonal components; and generating masking thresholds from the decimated linear tonal components and the decimated linear non-tonal components, wherein said global masking threshold is generated according to:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

where i and j are indices of logarithmic power components, z(i) is a Bark scale value for logarithmic power component i, $LT_{tonal}[z(j), z(i)]$ is a tonal masking threshold for logarithmic power components i and j, $LT_{noise}[z(j), z(i)]$ is a non-tonal masking threshold for logarithmic power components i and j, m is the number of tonal logarithmic power components, and n is the number of non-tonal logarithmic power components.

12. A mask generation process for use in encoding audio data, including:

generating logarithmic masking components; and generating respective masking thresholds from the logarithmic masking components using a masking function of the form:

$$vf=-17*dz, 0\leqq dz<8.$$

13. A mask generation process for use in encoding audio data, including:

generating logarithmic masking components; and generating a global masking threshold from the logarithmic masking components according to:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

where i and j are indices of spectral audio data, z(i) is a Bark scale value for spectral line i, $LT_{tonal}[z(i), z(i)]$ is a tonal masking threshold for lines i and j, $LT_{noise}[z(j), z(i)]$ is a non-tonal masking threshold for lines i and j, m is the number of tonal spectral lines, and n is the number of non-tonal spectral lines.

14. A mask generator for use in encoding audio data, comprising:

means for generating logarithmic masking components; and means for generating respective masking thresholds from the logarithmic masking components using a masking function of the form:

$$vf=-17*dz, 0\leqq dz<8.$$

15. A computer readable storage medium having stored thereon program code that, when loaded into a computer, causes the computer to execute steps comprising:

generating linear masking components from said audio data;

generating logarithmic masking components from said linear masking components; and generating a global masking threshold from the logarithmic masking components using a masking function of the form:

$$vf=-17*dz, 0\leqq dz<8.$$

16. A mask generator for an audio encoder, said mask generator comprising:

means for generating linear masking components from input audio data;

means for generating logarithmic masking components from said linear masking components; and means for generating a global masking threshold from the logarithmic masking components using a masking function of the form:

$$vf=-17*dz, 0\leqq dz<8.$$

17. An MPEG-1-L2 encoder, comprising:

means for generating energy values from Fourier transformed audio data;

means for determining sound pressure level values from said energy values;

means for selecting tonal and non-tonal masking components on the basis of said energy values;

means for generating power values from said energy values;

means for generating masking thresholds on the basis of said masking components and said power values; and means for generating signal to mask ratios for a quantizier on the basis of said sound pressure level values and said masking thresholds, wherein the encoder is configured to generate a normalized value x for an argument Ipt, according to:

$$Ipt=(1-x)2^m, 0.5<1-x\leqq 1$$

and using a second order Taylor expansion of a form $$\ln(1-x)\approx x-x^2/2$$

to approximate a logarithmic function as:

$$\log_{10}(Ipt)\approx[m*\ln(2)-(x+x^2/2)]*\log_{10}(e).$$

18. An audio encoder, comprising:

a bit stream generator; and a mask generator configured to:

generate linear masking components from audio data;

generate logarithmic masking components from the linear masking components; and generate a global masking threshold from the logarithmic masking components using a masking function of the form:

$$vf=-17*dz, 0\leqq dz<8.$$

19. The audio encoder of claim 18 wherein the mask generator is configured to generate the linear masking components by:

generating linear components in a frequency domain from the audio data;

selecting a first subset of the linear components as linear tonal components; and selecting a second subset of the linear components as linear non-tonal components.

20. The audio encoder of claim 19 wherein the mask generator is configured to generate sound pressure levels from the linear components using a second-order Taylor expansion of a logarithmic function.

21. The audio encoder of claim 20 wherein the mask generator is configured to generate a normalized value corresponding to an argument of the logarithmic function, and use the normalized value in the Taylor expansion.

22. The audio encoder of claim 19 wherein the mask generator is configured to generate the global masking threshold by:

decimating the linear tonal components and the linear non-tonal components; and generating masking thresholds from the decimated linear tonal components and the decimated linear non-tonal components.

23. The audio encoder of claim 22 wherein the mask generator is configured to generate the global masking threshold by determining maximum components of the masking thresholds and predetermined threshold values.

24. The audio encoder of claim 18 wherein the mask generator is configured to generate the logarithmic masking components using a second-order Taylor expansion of a logarithmic function.

25. The audio encoder of claim 18 wherein the linear masking components include linear energy components, and the logarithmic masking components include logarithmic power components.

26. The audio encoder of claim 18 wherein the encoder is MPEG-1 layer 2 audio compliant.

27. An audio encoder, comprising:

a bit stream generator; and a mask generator configured to:

generate linear masking components from audio data by:

generating linear components in a frequency domain from the audio data;

selecting a first subset of the linear components as linear tonal components; and selecting a second subset of the linear components as linear non-tonal components;

generate sound pressure levels from the linear components using a second-order Taylor expansion of a logarithmic function;

generate a normalized value corresponding to an argument of the logarithmic function, and use the normalized value in the Taylor expansion;

generate logarithmic masking components from the linear masking components; and generate a global masking threshold from the logarithmic masking components, wherein the mask generator is configured to generate the normalized value x for the argument Ipt, according to:

$$Ipt=(1-x)2^m, 0.5<1-x\leqq 1$$

using a second order Taylor expansion of the form $$\ln(1-x)\approx x-x^2/2$$

to approximate the logarithmic function as:

$$\log_{10}(Ipt)\approx[m*\ln(2)-(x+x^2/2)]*\log_{10}(e).$$

28. An audio encoder, comprising:

a bit stream generator; and a mask generator configured to:

generate linear masking components from audio data by:

generating linear components in a frequency domain from the audio data;

selecting a first subset of the linear components as linear tonal components; and selecting a second subset of the linear components as linear non-tonal components;

generate logarithmic masking components from the linear masking components; and generate a global masking threshold from the logarithmic masking components by decimating the linear tonal components and the linear non-tonal components; and generating masking thresholds from the decimated linear tonal components and the decimated linear non-tonal components, wherein the mask generator is configured to generate the global masking threshold according to:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

where i and j are indices of logarithmic power components, z(i) is a Bark scale value for logarithmic power component i, $LT_{tonal}$[z(j), z(i)] is a tonal masking threshold for logarithmic power components i and j, $LT_{noise}$[z(j), z(i)] is a non-tonal masking threshold for logarithmic power components i and j, m is the number of tonal logarithmic power components, and n is the number of non-tonal logarithmic power components.

29. An audio encoder, comprising:

a bit stream generator;

a filter bank;

a quantizer; and a mask generator is configured to:

generate logarithmic masking components; and generating respective masking thresholds from the logarithmic masking components using a masking function of the form:

$$vf=-17*dz, 0\leqq dz<8.$$

30. An audio encoder, comprising:

a bit stream generator;

a filter bank;

a quantizer; and a mask generator is configured to:

generate logarithmic masking components; and generate a global masking threshold from the logarithmic masking components according to:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

where i and j are indices of spectral audio data, z(i) is a Bark scale value for spectral line i, $LT_{tonal}$[z(j), z(i)] is a tonal masking threshold for lines i and j, $LT_{noise}$[z(j), z(i)] is a non-tonal masking threshold for lines i and j, m is the number of tonal spectral lines, and n is the number of non-tonal spectral lines.

* * * * *

UNITED STATES PATENT AND TRADEMARK OFFICE

CERTIFICATE OF CORRECTION

PATENT NO. : 7,634,400 B2
APPLICATION NO. : 10/795962
DATED : December 15, 2009
INVENTOR(S) : Charles Averty et al.

It is certified that error appears in the above-identified patent and that said Letters Patent is hereby corrected as shown below:

Title Page; Item 75
"Xue Yao" should read --Yao Xue--.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,634,400 B2
APPLICATION NO. : 10/795962
DATED : December 15, 2009
INVENTOR(S) : Averty et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1472 days.

Signed and Sealed this

Ninth Day of November, 2010

David J. Kappos

David J. Kappos
*Director of the United States Patent and Trademark Office*